US005843250A

United States Patent [19]

Bone et al.

[11] Patent Number: 5,843,250

[45] Date of Patent: Dec. 1, 1998

[54] METHOD OF FORMING AN IMAGE PATTERN ON A DIE PLATE

[75] Inventors: Steve A. Bone, Blue Springs; Randy A. Anderson; Mark S. C. Williams, both of Lee's Summit, all of Mo.

[73] Assignee: High Tech Polishing, Inc., Lee's Summit, Mo.

[21] Appl. No.: 699,567

[22] Filed: Aug. 19, 1996

[51] Int. Cl.[6] ..... B44C 1/00

[52] U.S. Cl. ..... 156/58; 216/32; 438/689; 438/690; 438/694

[58] Field of Search ..... 156/58; 216/32; 438/689, 690, 694

[56] References Cited

U.S. PATENT DOCUMENTS

| | | | |
|---|---|---|---|
| 4,968,064 | 11/1990 | Mancuso | 283/91 |
| 5,336,458 | 8/1994 | Hutchison et al. | 264/220 |
| 5,364,494 | 11/1994 | Hutchison et al. | 156/642 |

OTHER PUBLICATIONS

"Prismatic Imaging" booklet, pp. 1–11, R.J.M. Graphics, Inc., Middleboro, MA.

*Primary Examiner*—John Kight
*Assistant Examiner*—Everett White
*Attorney, Agent, or Firm*—Chase & Yakimo

[57] ABSTRACT

A method for engraving an image pattern onto an impression die plate utilizes laser engraving and acid attacking techniques. In one embodiment, a brass plate is provided having a nickel coating thereon. A laser removes selected portions of the nickel coating according to a preselected image pattern so as to expose the underlying portions of the brass plate. Upon immersion of the plate into an acid bath, the acid attacks the exposed plate portions so as to present depressions in the plate. Upon removal of the plate from the bath a series of depressions and remaining coating portions on the plate present undulations thereon corresponding to the desired pattern image. This image is then impressed onto a medium, e.g. as a foil or the like. Various materials may be used for the plate, coating and acid bath. An electrically charged chrome coating may also be used with a non-electrically charged chrome being the acid bath.

12 Claims, 5 Drawing Sheets

METHOD OF FORMING AN IMAGE PATTERN ON A DIE PLATE

BACKGROUND OF THE INVENTION

This invention relates to a process for making a pattern die for use in embossing foil or other media, and more particularly, to a novel efficient method for making a die having a pattern mask thereon, the pattern resulting from a combination of laser and acid etching techniques.

Prints which display different images dependent on the observer's angle of view are known. One such print type is holography which utilizes diffraction grating to separate white light into its spectral components. This diffraction grating presents a high number of lines per inch on the print which reflects or transmits different portions of the incident spectrum of light as the angle of viewing changes. This process is an expensive one.

In lieu of the diffraction principal, other prints utilize an embossed foil having a plurality of raised lines and grooves thereon, corresponding to a desired image, which reflect white light as light and dark lines. The reflective lines appear to shift as the viewing angle changes so as to vary the image.

Another process for making a variable color print having different designated image regions thereon, is shown in U.S. Pat. No. 4,968,064. Therein a color print has different image regions, the image regions presenting one or more color variations depending on the angle of viewing. A line pattern for each region is established and transferred to the image medium via an impression die. The die is made by a conventional photosensitive resist technique.

One particular application of the above discussed embossed foil is in connection with sports player trading cards, the embossed foil forming a background for the player's image. Other color indicia may also be printed on this foil including the player's image according to the desires of the artist. Depending on the angle of card viewing, the light refracted from the patterned foil will change so as to present aesthetically pleasing images reflected therefrom.

The production of the light reflecting undulations on this background foil is provided by a die having a number of ridges and grooves thereon, these undulations presenting a reverse image of the desired image to be formed on the foil. The reverse image may be engraved onto the metal die by a conventional engraving processes which is a relatively time consuming and expensive process even with the use of today's laser technology.

A photo resist process utilizes a die plate covered with a photo resistant material. An image defining negative is placed over the plate with light then exposed onto the plate. The light passes through unrestricted portions of the negative so as to soften the photo resist which is then washed away. Bare metal areas of the plate are thus exposed for chemical etching. The chemical etching cuts out the grooves which define a portion of the image pattern on the plate. Subsequent engraving must be done so as to form the grooves to the desired shapes and dimensions.

Today's laser technology enables art work to be translated into a laser readable form for laser engraving onto the die plate. However this process is a time consuming and expensive one which restricts the job output of the laser.

Thus, it is desirable to utilize today's expensive laser technology in a timely and efficient manner. In response thereto we have invented a method utilizing laser technology which efficiently transfers a desired image pattern onto a die plate. Our method generally comprises coating a brass die plate with an acid resistant material, e.g. nickel, with a subsequent laser engraving of the desired image into this nickel coating. Upon submerging the coated plate into an acid bath, the acid will attack the exposed portions of the plate, i.e., those portions exposed by removal of the nickel coating, until the desired depth of the depressions/grooves in the die plate is achieved. Upon removal of the plate from the acid bath the grooves and remaining coating on the plate presents undulations corresponding to the desired reverse image pattern for transfer to the embossed foil.

It is accordingly a general object of this invention to provide a new method of making die plate for use in embossing image forming undulations onto a foil medium or the like.

Another object of this invention is to provide a method, as aforesaid, which utilizes today's laser technology.

A further object of this invention is to provide a method, as aforesaid, which precludes the need for laser engraving onto the die plate proper.

A further object of this invention is to provide a method, as aforesaid, which increases the job output of laser apparatus.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Turning more particularly to the drawings, FIGS. 1–10 show our new method for making an impression die 100, the die used for embossing undulations onto a foil background. The die will have a reverse image pattern thereon for transfer to a foil medium or the like, the foil forming a background of a finished trading card.

Figure 1:
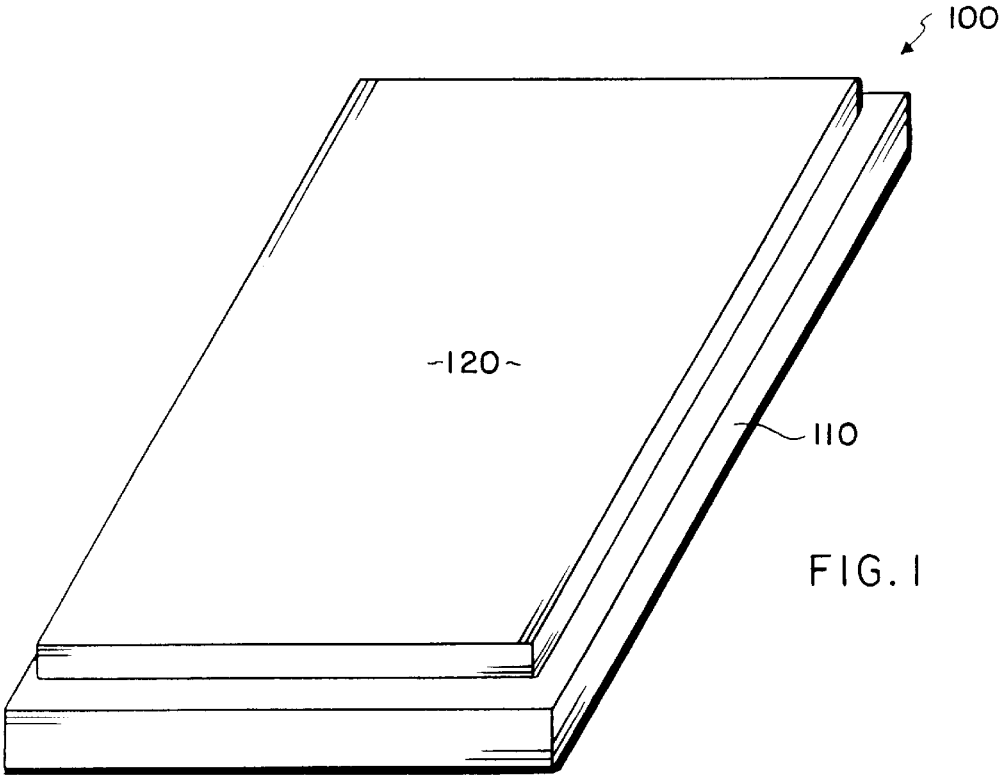
FIG. 1 is a perspective view showing a die plate prior to the image pattern/pattern mask being embossed thereon.

FIG. 1 shows a brass die plate 100 having a base 110 and an image pattern impression surface 120 thereon, it being understood that the impression surface 120 will generally correspond to the foil surface area of the finished trading card. A reverse of the image pattern is desired to be engraved onto this surface 120, the image pattern comprising a plurality of grooves and ridges thereon arranged to present the desired background design. Upon the plate 100 being impressed on the foil the image pattern will be transferred to such foil. The resulting undulations on the foil of the finished trading card will reflect light. The reflected light will present different images according to the angle of view of the observer. Thus various aesthetic background images will be presented.

It is understood that various images may be positioned on surface 120 for transfer to the foil medium. In order to simplify the discussion hereinbelow, we have chosen a simple diamond image for transfer onto the die surface 120, this reverse diamond image then being impressed onto the foil of the accompanying trading card.

Figure 2:
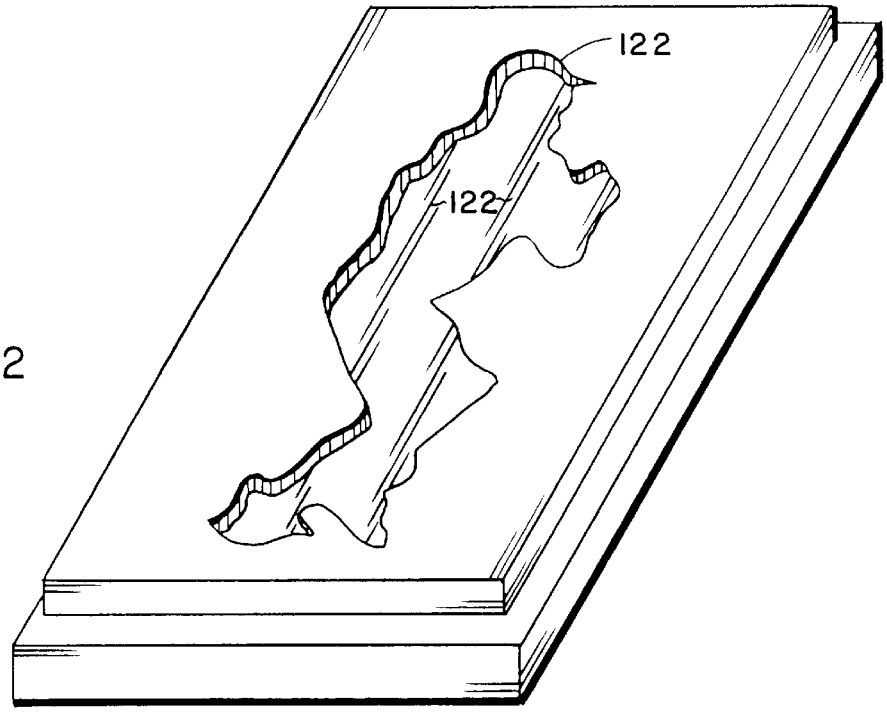
FIG. 2 is the plate of FIG. 1 having a milled portion corresponding to a player's image.

FIG. 2 shows a portion 122 of the surface 120 being milled, the milled portion 122 corresponding to the outline of the player's image. The player's image will be inserted therein during subsequent card assembly. It is understood that the milled portion 122 need not be used as a player's image may be formed directly on the surface 120 for subsequent transfer.

Figure 3:
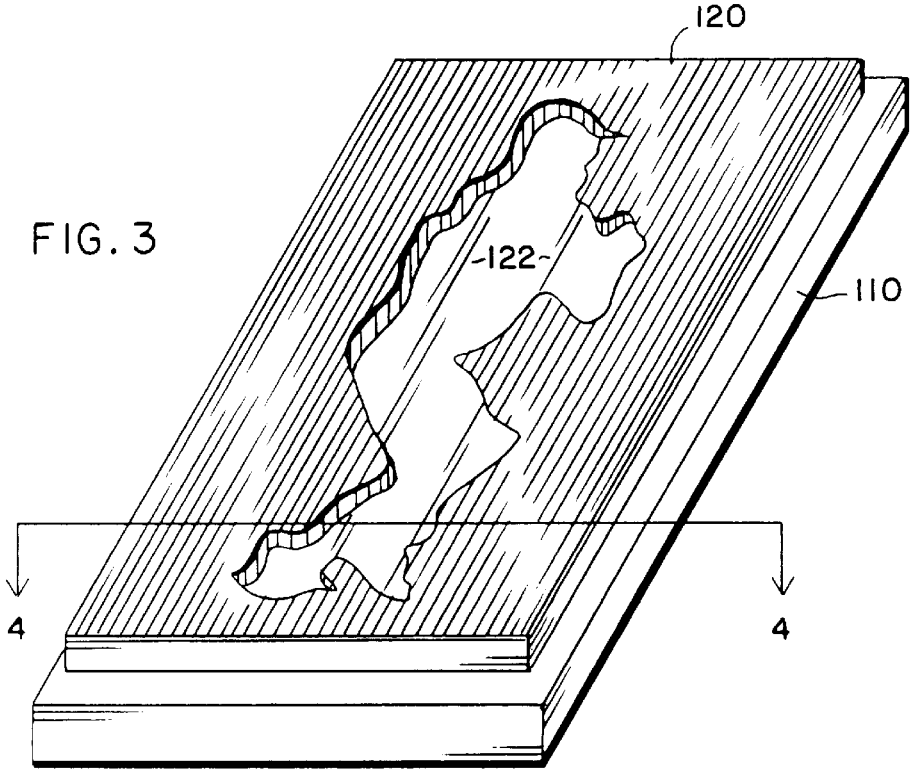
FIG. 3 is the plate of FIG. 2 with a nickel coating thereon.
Figure 4:
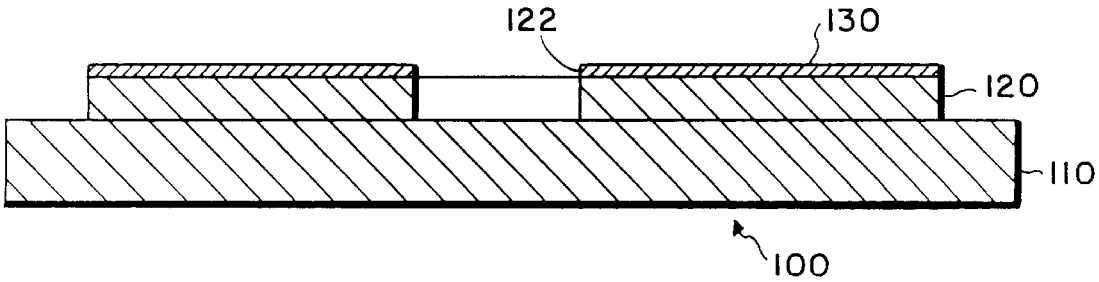
FIG. 4 is a sectional view, taken along line 4—4 of FIG. 3, showing a coating atop the plate.
Figure 7:
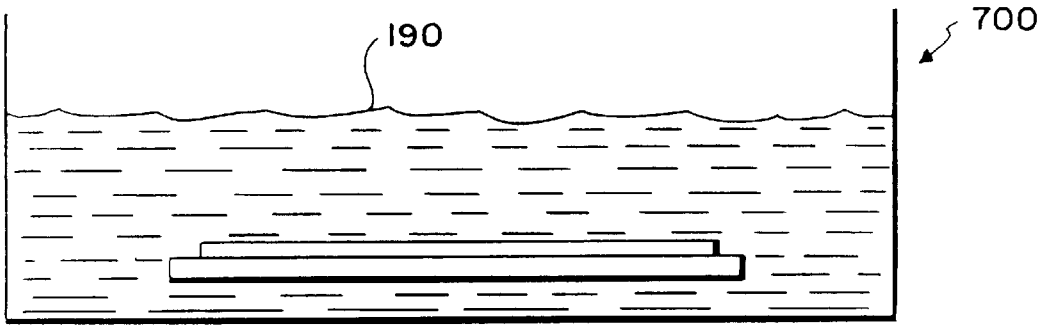
FIG. 7 is a diagrammatic view showing the plate emerged in an acid bath.

FIG. 3 shows the addition of a layer of an acid-resistant nickel 130 coating atop the surface 120, it being understood that this nickel 130 is resistant to the acid 190 being utilized in the acid bath 700 of FIG. 7. It is understood that the use of a nickel coating is representative of only one coating that may be utilized as other acid resisting compounds are available. Thus various coatings 130 may be used according to the desires of the user.

Figure 5:
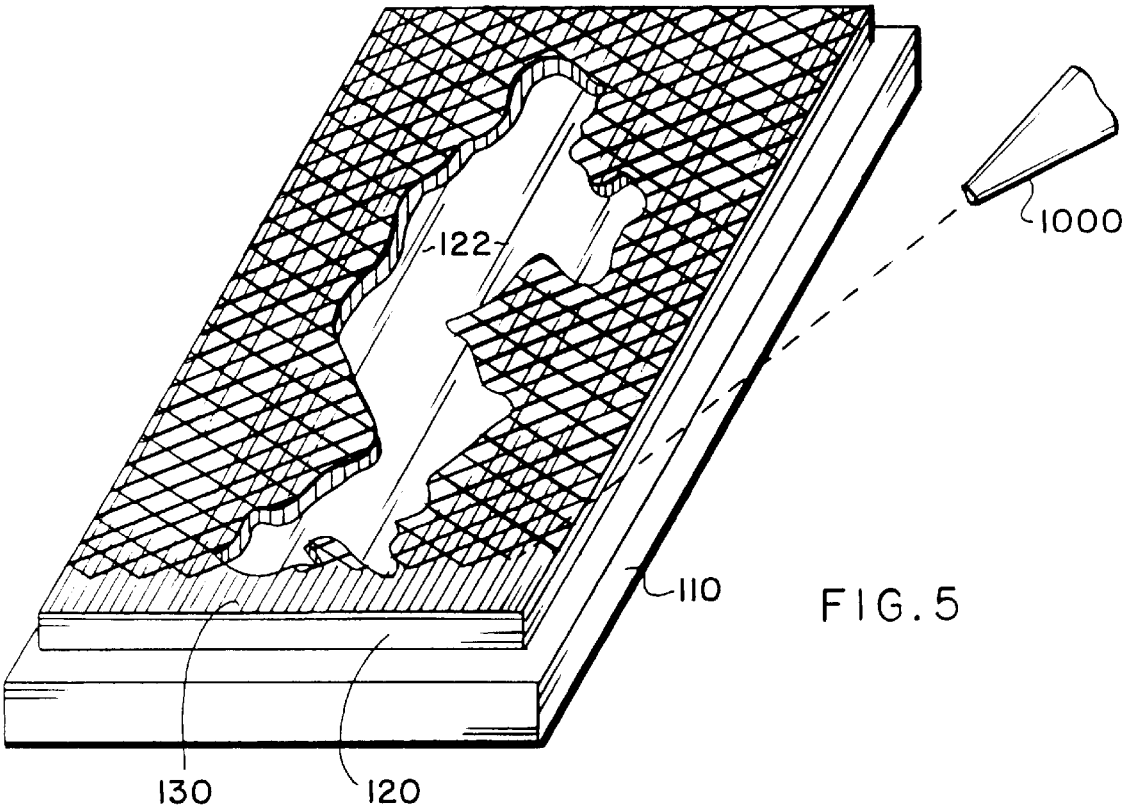
FIG. 5 is a view of the plate of FIG. 4 showing a diamond pattern image being engraved into the coating by a laser as diagrammatically shown.
Figure 6:
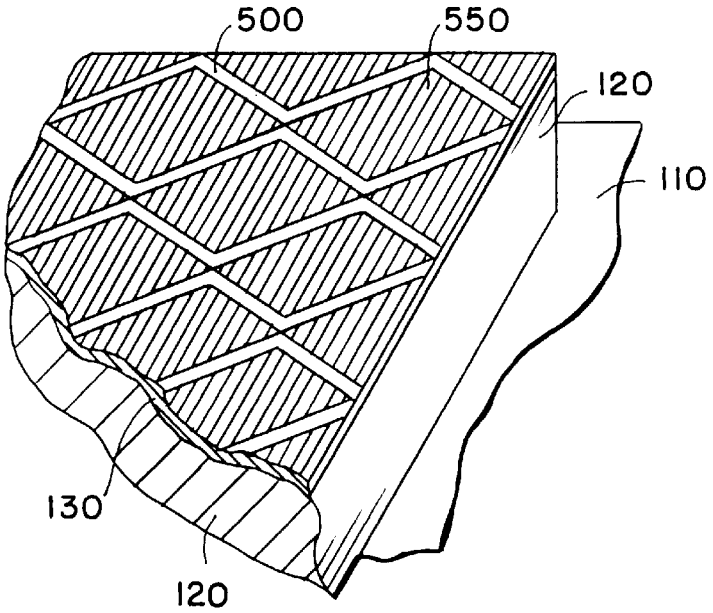
FIG. 6 is a fragmentary view of one corner of the plate of FIG. 5 on an enlarged scale.

FIG. 5 diagrammatically shows a laser engraving of the desired image pattern into the coating 130 using available laser 1000 technology. It is understood that the desired image pattern is initially presented in the form of art work, the art work capable of being converted into a form readable by the laser apparatus. The laser 1000 will then translate certain lines of the converted art work into grooves which heretofore have been engraved directly into the die plate image surface 120, a time consuming process. One such laser apparatus is the AB LASER MODEL STARMARK.

As shown in FIG. 5 the laser 1000 engraves grooves 500 only in the nickel coating 130, these grooves 500 surrounding the diamonds 550. This engraving exposes portions of the underlying brass plate surface 120. As our method requires the laser to engrave a relatively thinner depth in the nickel coating 130, as opposed to the desired depth of the engraving in the plate surface 120, our method reduces the time of laser use for a particular job.

Another coating which can be applied in the above method is a chrome which has been electrically charged so as to adhere to the plate surface 120. The liquid in the bath can then be a non-electrically charged chrome. Upon immersion of the die plate into the bath the chrome in the bath will attack the exposed brass portions of the plate 100. However, the chrome bath will not attack the chrome coating.

Figure 8:
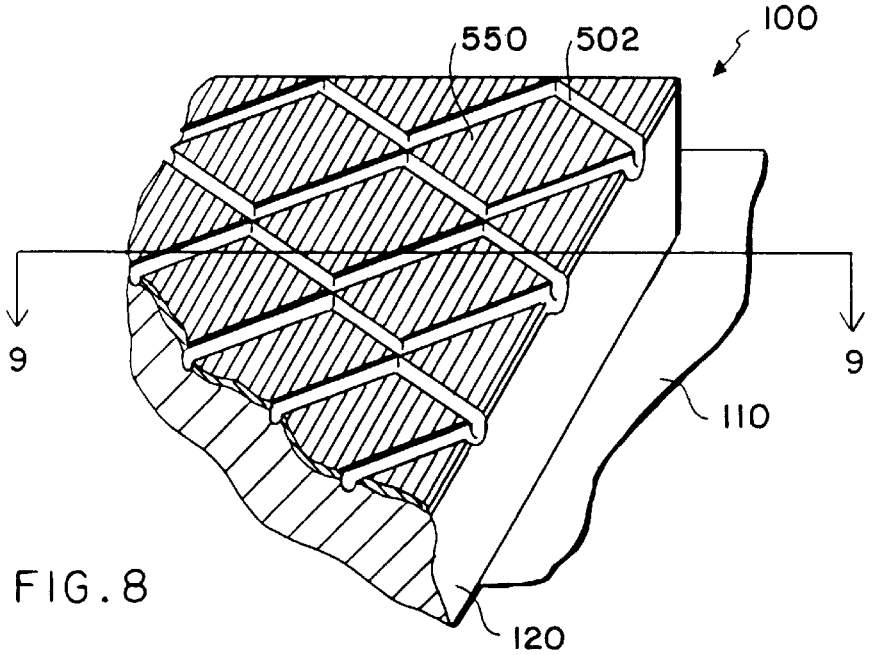
FIG. 8 is a view of one corner of the plate, on an enlarged scale, subsequent to removal from the acid bath.
Figure 9:
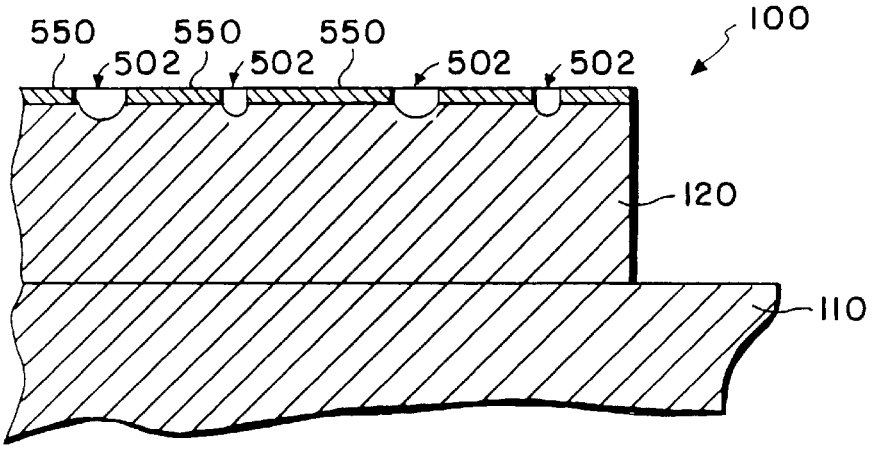
FIG. 9 is a view taken along line 9—9 in FIG. 8.
Figure 10:
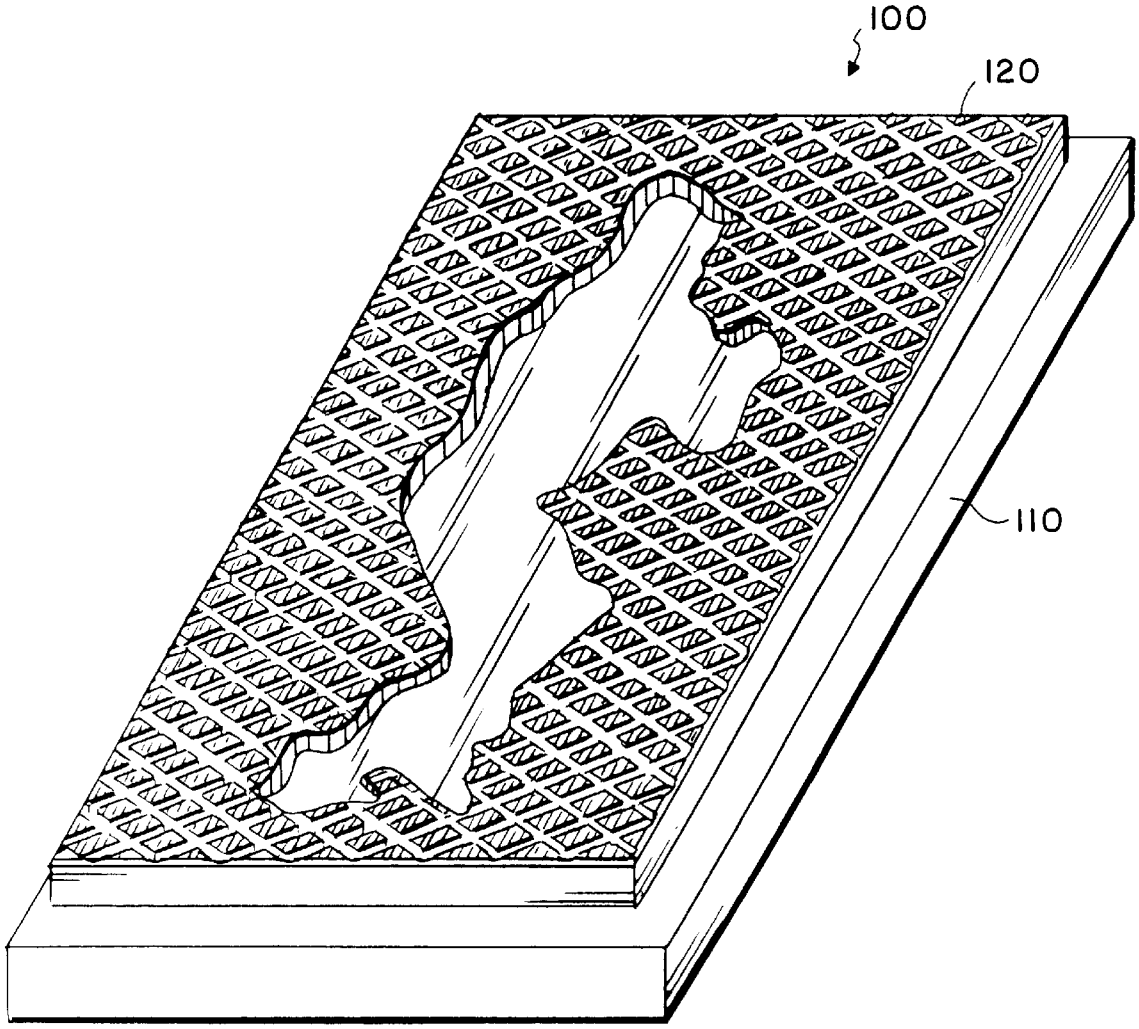
FIG. 10 is a perspective view of the finished plate having the desired image pattern thereon.

Subsequently the plate 100 is placed into an acid bath 700 (FIG. 7), the acid being of a type which will attack the exposed portions of brass plate 100. The period of immersion in this acid bath 700 is dictated by the desired depth of the resulting depressions/grooves 502 in the plate surface 120. As shown in FIGS. 8 and 9, these resulting grooves 502 cooperate with the remaining nickel coating portions 130 so as to present undulations on plate 120, these undulations presenting the desired reverse image on the plate surface 120 for transfer to the foil medium of the trading card.

Accordingly, we have found that our method as above described, efficiently produces an impression die. Moreover, the method results in reduction of laser on line time so as to make the laser apparatus available for other uses. Thus the job output of the laser apparatus will also increase.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A method of producing an image pattern onto a die, the die adapted to transfer the image to a foil comprising the steps of:

providing a desired image pattern;

providing a plate made of a material susceptible to a selected acid;

coating said plate with a material resistive to said acid;

utilizing a laser for removing portions of said coating from said plate corresponding to portions of said image pattern, said removal exposing portions of said plate underneath said coating;

placing said plate in a bath containing said acid, said acid attacking said plate at said exposed portions to present a plurality of corresponding depressions therein; and removing said plate from said acid bath, said plate presenting said plurality of depressions and raised portions corresponding to remaining portions of said coating on said plate, said depressions and raised portions producing undulations forming said image pattern on said plate for impression transfer to a foil medium.

2. A method of producing an image pattern onto a die as claimed in claim 1, wherein said plate comprises a brass material.

3. A method of producing an image pattern onto a die as claimed in claim 2, wherein said coating is a nickel coating.

4. A method of producing an image pattern on a die as claimed in claim 2, wherein said coating is a chrome.

5. A method of producing an image pattern onto a die as claimed in claim 4, wherein said acid is a chrome adapted to attack said brass.

6. A method of producing an image pattern onto a die, the die adapted to transfer the image to a light reflective medium comprising the steps of:

creating a desired image pattern for transfer to a reflective medium;

providing a plate made of a material susceptible to breakdown by a selected substance;

coating said plate with a material resistive to said substance;

engraving portions of said coating on said plate corresponding to selected portions of said image pattern, said engraving exposing portions of said plate susceptible to said substance;

applying said substance to said exposed portions, said substance attacking said exposed portions of said plate in a manner to present corresponding depressions therein; and ceasing the attacking action of said substance, said plate presenting a plurality of depressions corresponding to said exposed portions of said plate and raised portions corresponding to portions of said coating remaining on said plate, said depressions and raised portions forming an embossed image pattern on said plate for transfer to a reflective medium.

7. A method of producing an image pattern onto a die as claimed in claim 6, wherein said medium is a foil.

8. A method of producing an image pattern onto a die as claimed in claim 6, wherein said substance is a chrome adapted to attack said plate material.

9. A method of producing an image pattern onto a die as claimed in claim 8, wherein said coating comprises a chrome material.

10. A method of producing an image pattern onto a die as claimed in claim 6, wherein said engraving step utilizes a laser.

11. A method of producing an image pattern onto a die, the die adapted to transfer the image to another medium comprising the steps of:

providing a desired image pattern;

providing a plate made of a material susceptible to attack by a chrome material;

coating said plate with an electrically charged chrome material;

removing portions of said coating from said plate corresponding to selected portions of said image pattern, said removal exposing portions of said plate underneath said coating;

placing said plate in a chrome bath, said chrome in said bath having no electrical charge, said bath attacking said exposed plate portions to present a plurality of depressions therein; and removing said plate from said chrome bath, said plate presenting a plurality of depressions corresponding to said portions of said plate attacked by said chrome with portions of said remaining chrome coating presenting raised portions on said plate, said depressions and raised portions producing undulations forming said image pattern on said plate for transfer to another medium.

12. A method of producing an image pattern onto a die as claimed in claim 11, wherein said removing step is performed by a laser.

* * * * *